US006146016A

United States Patent [19]

Mucci et al.

[11] Patent Number: 6,146,016

[45] Date of Patent: Nov. 14, 2000

[54] HANDLE CLOSURE SYSTEM

[75] Inventors: Michael A. Mucci, 52 Pipers Hill Rd., Wilton, Conn. 06897-1511; William S. Roberts, 43 Cedar Rd., Wilton, Conn. 06897-3627; Suzanne Roberts, Wilton, Conn.

[73] Assignees: Michael A. Mucci; William S. Roberts, both of Wilton, Conn.

[21] Appl. No.: 09/321,841

[22] Filed: May 28, 1999

[51] Int. Cl.[7] ..... B65D 30/16; B65D 33/16; B65D 33/06

[52] U.S. Cl. ..... 383/7; 383/15; 383/40; 383/89; 383/121.1

[58] Field of Search ..... 383/7, 88, 89, 383/40, 121.1, 15

[56] References Cited

U.S. PATENT DOCUMENTS

| | | | |
|---|---|---|---|
| D. 404,615 | 1/1999 | Wyant . | |
| 1,341,404 | 5/1920 | Wisniewska | 383/40 |
| 2,114,367 | 4/1938 | Berkowitz | 383/88 |
| 2,339,304 | 1/1944 | Von Haase | 383/88 |
| 2,793,743 | 5/1957 | Lefebvre | 383/89 |
| 2,947,464 | 8/1960 | Newton . | |
| 3,067,926 | 12/1962 | Brady . | |
| 3,149,771 | 9/1964 | Pearl | 383/89 |
| 3,203,551 | 8/1965 | Van Loan, Jr. | 383/89 |
| 3,446,420 | 5/1969 | Rinecker | 383/89 |
| 3,540,475 | 11/1970 | Dickard et al. | 383/89 |
| 3,655,118 | 4/1972 | Rinecker | 383/89 |
| 3,688,973 | 9/1972 | Lillkvist . | |
| 4,071,186 | 1/1978 | Ruda | 383/89 |
| 4,483,445 | 11/1984 | Lepisto et al. | 383/7 |
| 4,706,297 | 11/1987 | Ausnit | 383/89 |
| 4,930,903 | 6/1990 | Mahoney | 383/121.1 |
| 5,265,960 | 11/1993 | Shikler . | |

FOREIGN PATENT DOCUMENTS

| | | | |
|---|---|---|---|
| 89978 | 2/1961 | Denmark | 383/89 |
| 60105 | 2/1961 | Norway | 383/88 |
| 2070564 | 9/1981 | United Kingdom | 383/89 |

*Primary Examiner*—Stephen P. Garbe
*Attorney, Agent, or Firm*—Pennie & Edmonds LLP

[57] ABSTRACT

A mating closure system includes a first closure element and a second closure element, where at least one of the closure elements includes a cut-out opening. Preferably both closure elements include matching cut-out openings. The cut-out opening may be formed in a variety of shapes, but an arc or elongated oval is preferred. The first closure element is placed adjacent an opening of a bag. The second closure element is displaced from the opening, such that when the bag portion adjacent the opening is folded down the first and second closure elements mate with the cut-out openings substantially aligning to form a handle with a resulting notch for accommodating a user's fingers.

20 Claims, 9 Drawing Sheets

HANDLE CLOSURE SYSTEM

This invention relates generally to closure systems. More particularly, this invention relates to closure systems for reusable bags. Still, more particularly, this invention relates to a handle closure system used to close and carry lunch bags.

BACKGROUND

Bags are used to carry many different items. For example, lunch bags that carry food items have been used for many years and come in a variety of styles and shapes. Paper bags are often used to carry food items. The paper lunch bags are typically packaged in a flat position and become expanded when filled with food items. Typically, the top of the bag is rolled down to close the bag and provide a means to carry the bag. Use of the folded portion of the paper bag as a handle causes the bag to wear quicker. Moreover, when the folded closed portion of the bag is not grasped the folded portion tends toward an unfolded position such that the contents are not sealed within the bag. Further, paper bags become easily damaged after minimal use. They are susceptible to tears and water damage. Thus, the bags are typically used once and then thrown out.

Other types of lunch bags include vinyl lunch bags, which are reusable and washable. The folded portion of the bag is typically grabbed as a handle or a strap is included on the top of the bag for carrying the bag. These bags are typically expensive. Other lunch storage containers exist, such as metal or plastic lunch boxes. These are reusable and generally suffer little wear when used. Further, they typically include a comfortable handle. However, lunch boxes are bulky to carry and difficult to store because they do not fold into a compact form for storage.

Other bags used to carry items, such as department store bags, typically have a hole in a top portion of the bag near an opening for use as a handle. Otherwise, the bags typically feature handles or straps attached to the top of the bag. The bags do not seal, and thus, contents can easily slip out of the bag and become lost.

SUMMARY OF THE INVENTION

This invention provides a handle closure system for bags. The handle closure system is useful on all types of bags, including lunch bags, department store bags, beach bags and giveaway bags. Many other types bags could use this handle closure system. Typically, the bags will include front and back panels with two side gussets connecting the front and back panels and a flat bottom panel connected to the front and back panels and the side gussets. The bags may also be of a different style such as one having attached front and back panels and a bottom gusset to accommodate items that are placed within the bag. The bags can be stored in a flat position and later expanded to accommodate items. The bags of the present invention are preferably made of low density polyethylene. The bags can also be made of polyethylene of other densities, polypropylene, vinyl or any other suitable material. These materials may be used in a variety of thicknesses which may depend on the ultimate use of the bag.

The handle closure system uses a closure mechanism such as a hook and loop fastener, reusable adhesive tape, or the like known to those skilled in the art. The closure mechanism is formed as a first closure element and a second closure element. The closure elements each include a cut-out opening. Preferably, hook and loop material is used to form the closure elements. The hook and loop materials are pressure sensitive and secure to each other with minimal pressure. The hook and loop materials have an adhesive backing for applying to the bag material. A first closure element is placed on either the front or the back panel of the bag adjacent to an opening of the bag. The second mating closure element is located on the bag displaced from the opening such that a top portion of the bag can be folded down and the closure elements can be mated. The folding of the bag and the mating of the closure elements assists in preventing items from falling out of the bag and odors from leaking from the bag. Preferably, the mating second closure element is placed on the other panel of the bag. The closure elements are placed on the bag such that when the bag is closed, the cut-out openings face toward the bottom of the bag. The cut-out openings will substantially align to form a resulting notch such that the bag is sealed and the resulting notch assists in forming a handle for carrying the bag by allowing placement of the fingers within the notch.

BRIEF DESCRIPTION OF THE DRAWINGS

Reference is made to a brief description of the drawings, which are intended to illustrate embodiments of the handle closure system.

DETAILED DESCRIPTION

Figure 1:
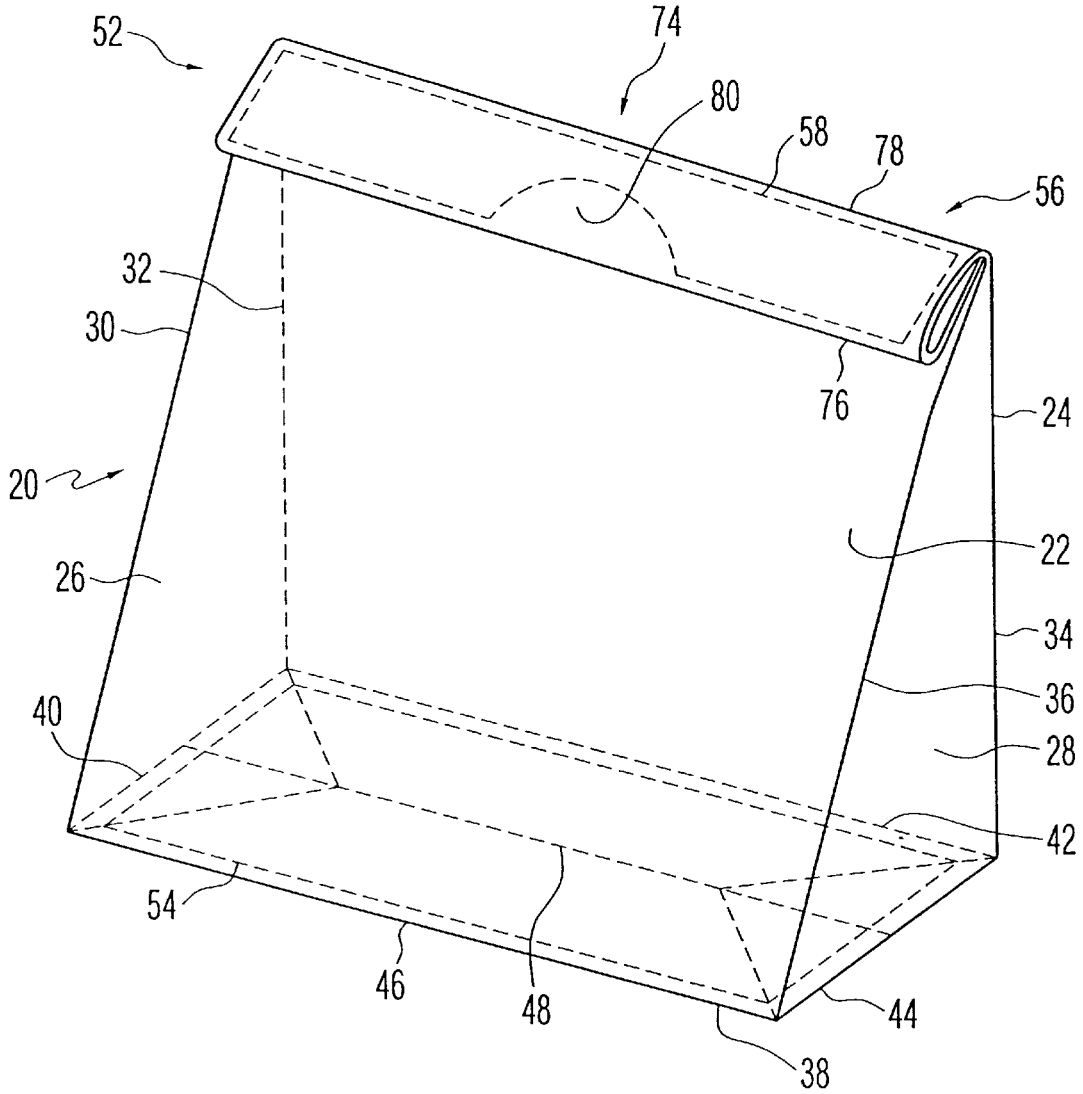
FIG. 1 is a perspective view of a first bag having side gussets, the bag having a handle closure system according to the present invention.

Referring to FIG. 1, a conventional bag 20 is shown in a folded closed position. The bag 20 includes a front panel 22 and a back panel 24. The front and back panels 22 and 24 are attached via a first side gusset 26 and a second side gusset 28. The first side gusset 26 is attached to the front and back panels 22 and 24 by a first and second side folds 30 and 32. The second side gusset 28 is attached to the front and back panels 22 and 24 by a third and fourth side folds 34 and 36. The bag 20 also includes a bottom panel 38 having four sides 40, 42, 44, and 46.

Figure 3:
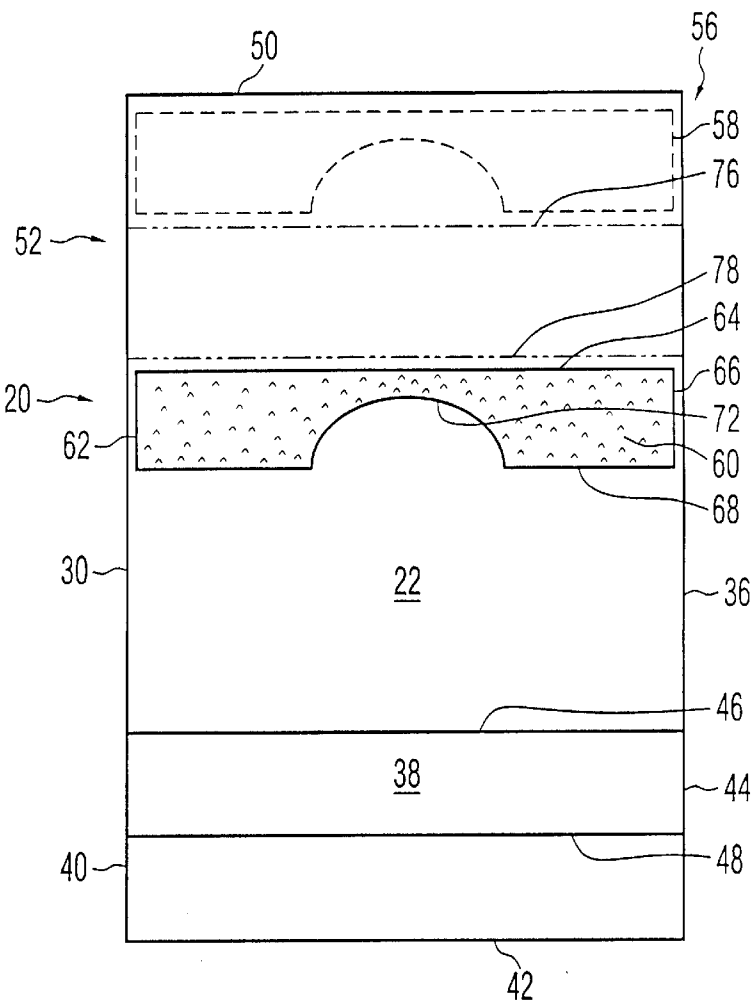
FIG. 3 is a front view of the first bag flattened with the handle closure system.
Figure 2:
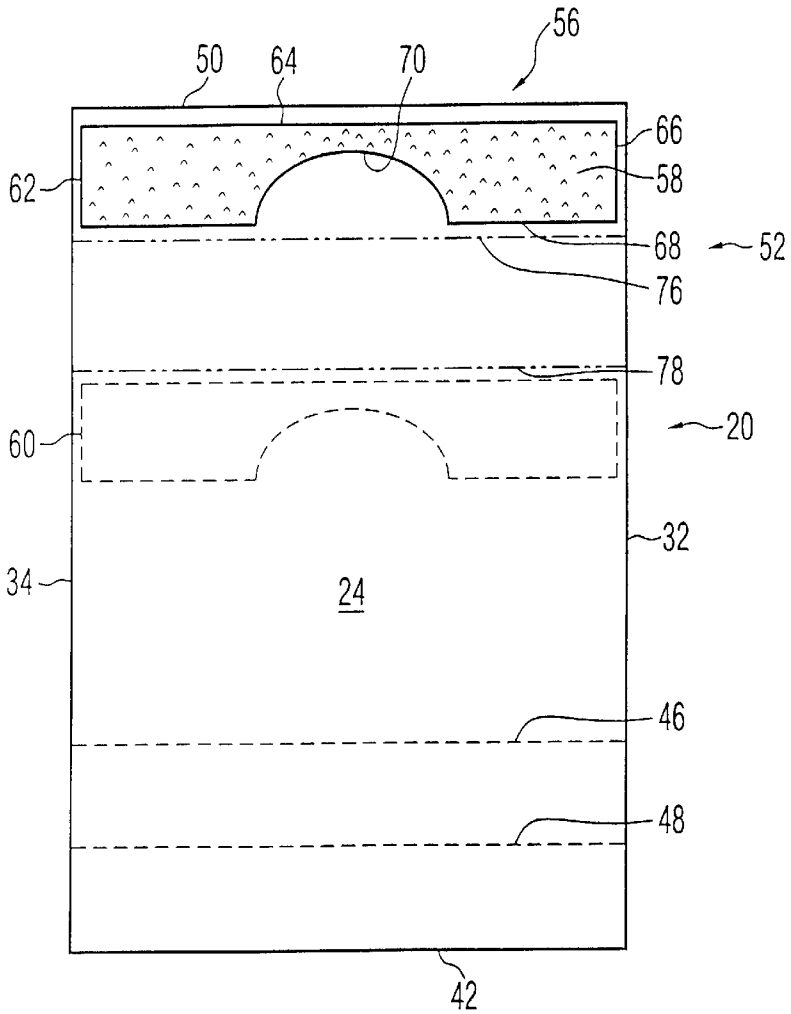
FIG. 2 is a back view of the first bag flattened with the handle closure system.

Each side 40, 42, 44, and 46 is attached to one of the front and back panels 22 and 24 or side panels 26 and 28. Referring to FIGS. 2–3 the bag is shown flattened, a bottom seam 48 runs along the center of the bottom panel 38. Opposite the bottom panel 38 of the bag 20 is an opening 50 to the bag 20 with a top portion 52 of the bag 20 located adjacent the opening 50. A removable insert 54 is preferably placed in the bottom of the bag 20 to stiffen the bottom panel 38 for holding items placed within the bag 20 (shown in FIG. 1). The bag 20 can be stored in a flat position (shown in FIGS. 2 and 3) and expanded through use of the side gussets 26 and 28 when items are placed within the bag 20. A handle closure system 56 is shown at the top portion 52 of the bag 20.

A preferred embodiment of the handle closure system 56 is shown in FIGS. 1–3. The handle closure system 56 features a first closure element 58 and a second closure element 60. Each closure element 58 adn 60, as shown, is made of hook and loop fastener. Each first and second closure element 58 and 60 preferably has four sides 62, 64, 66 and 68. On one side 68 of at least one closure element 58, a cut-out opening 70 is formed. As shown, preferably both closure elements 58 and 60 include matching cut-out openings 70 and 72. In the embodiment shown, preferably the cut-out openings 70 and 72 are substantially arcuate. The first and second closure elements 58 and 60 are located on the bag 20 such that when the top portion 52 of the bag 20 adjacent the opening 50 is folded down, the first and second closure elements 58 and 60 mate to close the bag 20 and form a handle 74.

Figure 4:
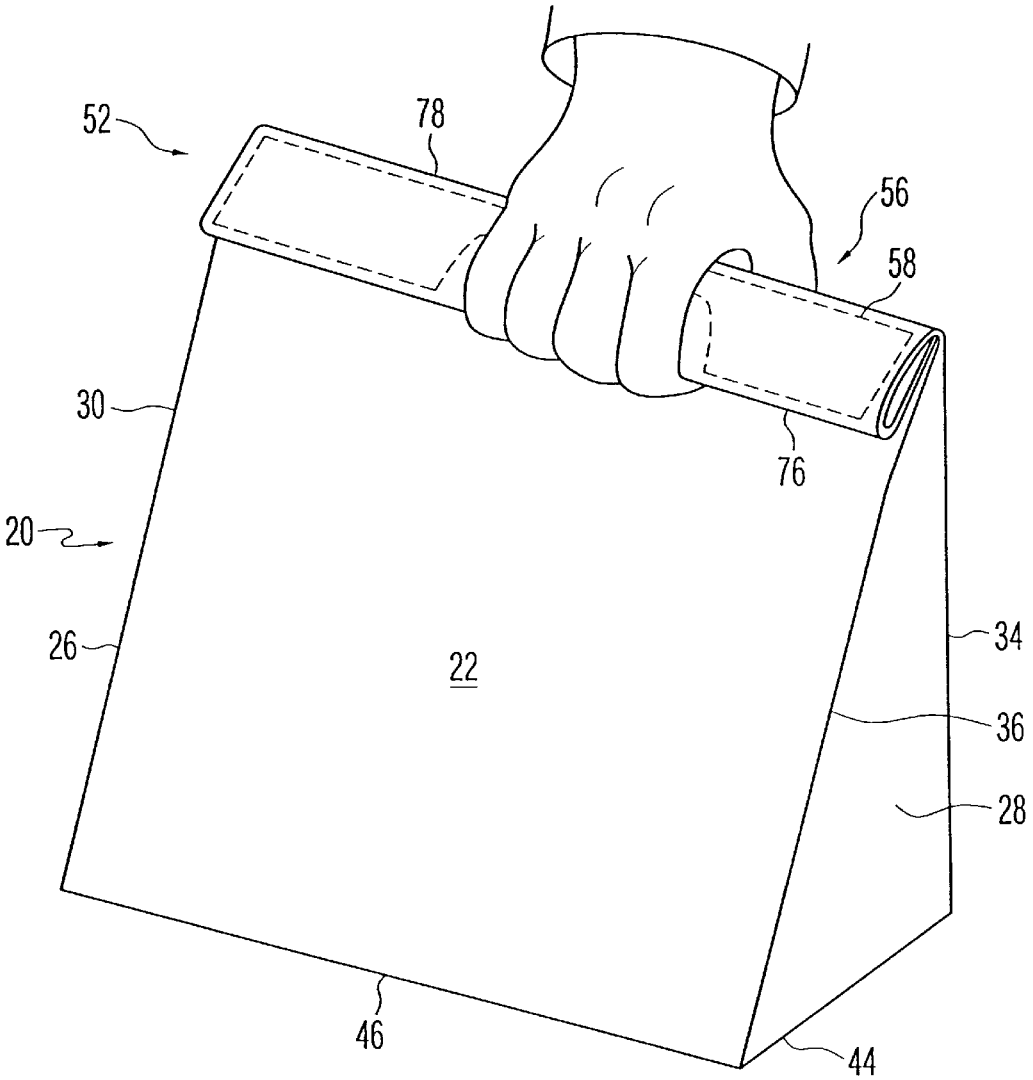
FIG. 4 is a perspective view of the first bag according to the present invention in use.

Referring to FIG. 2, the back panel 24 of the bag 20 is shown. The back panel 24 includes a first closure element 58 located adjacent the opening 50 of the bag 20. The cut-out opening 70 is positioned facing away from the opening 50 toward the bottom panel 38 of the bag 20. Referring to FIG. 3, the front panel 22 includes a second closure element 60 displaced from the opening 50 of the bag 20. The cut-out opening 72 is positioned facing away from the opening 50 toward the bottom panel 38 of the bag 20. The bottom panel 38 is shown folded onto the front panel 22. The bottom panel 38 can be folded onto either the back or front panel 24 and 22 to lay the bag 20 flat for easier storage. As shown in FIGS. 2–3, preferably the top portion 52 of the bag 20 is folded along two folds 76 and 78 to close the opening 50, such that the first closure element 58 is mated with the second closure element 60, and the cut-out openings 70 and 72 align to form a handle 74 with a notch 80 (shown in FIG. 1). The two preferred folds 76 and 78, along with the closure elements 5 8 and 60 close the bag 20 in such a manner that items cannot easily fall out of the bag 20. The notch 80 is provided for placement of the fingers when the handle closure system 56 is grabbed to carry the bag 20. Referring to FIG. 4, the handle closure system 56 on the first bag 20 is shown in use.

Figure 5:
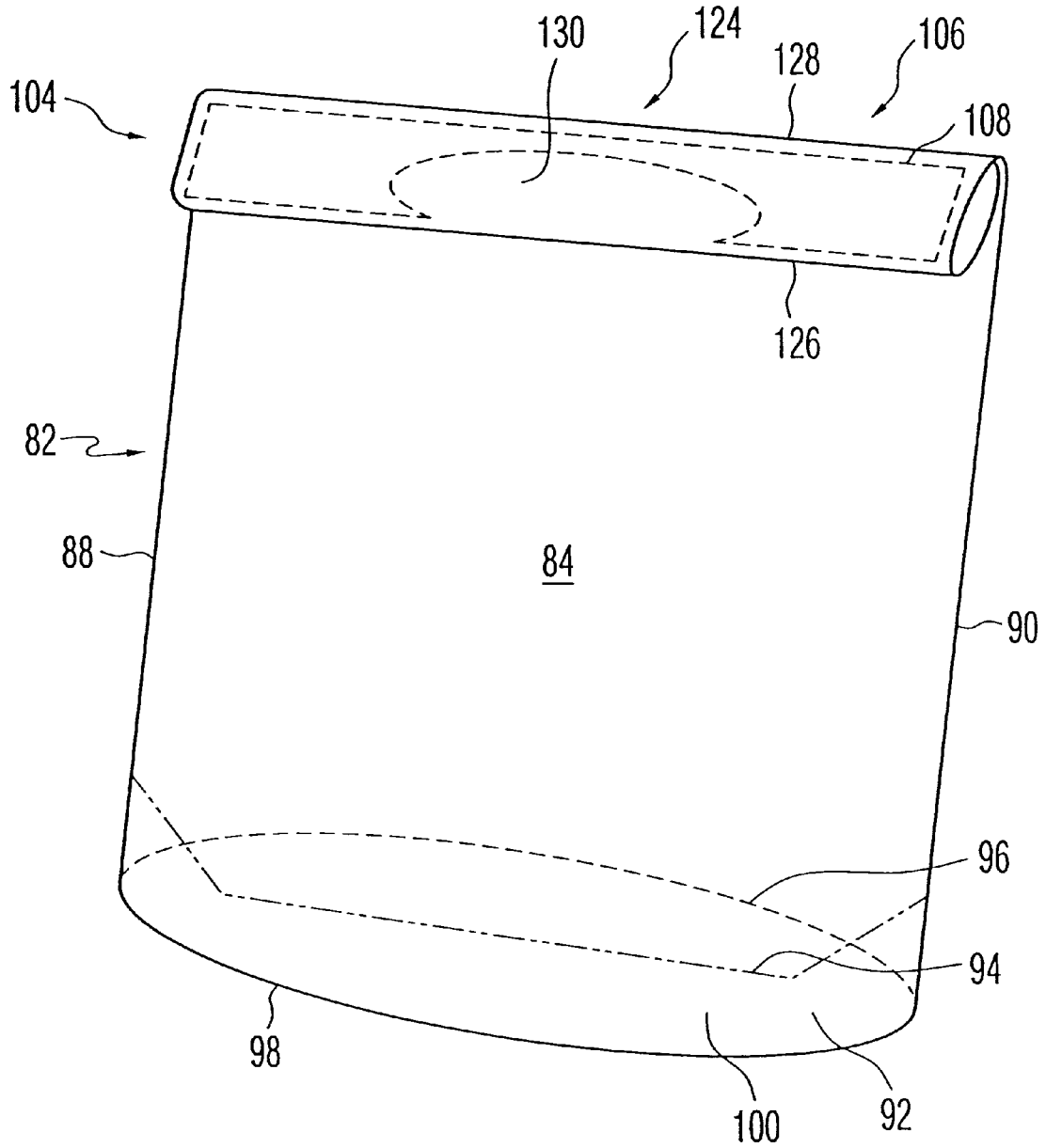
FIG. 5 is a perspective view of a second bag having a bottom gusset, the bag having a handle closure system according the present invention that is folded closed.
Figure 7:
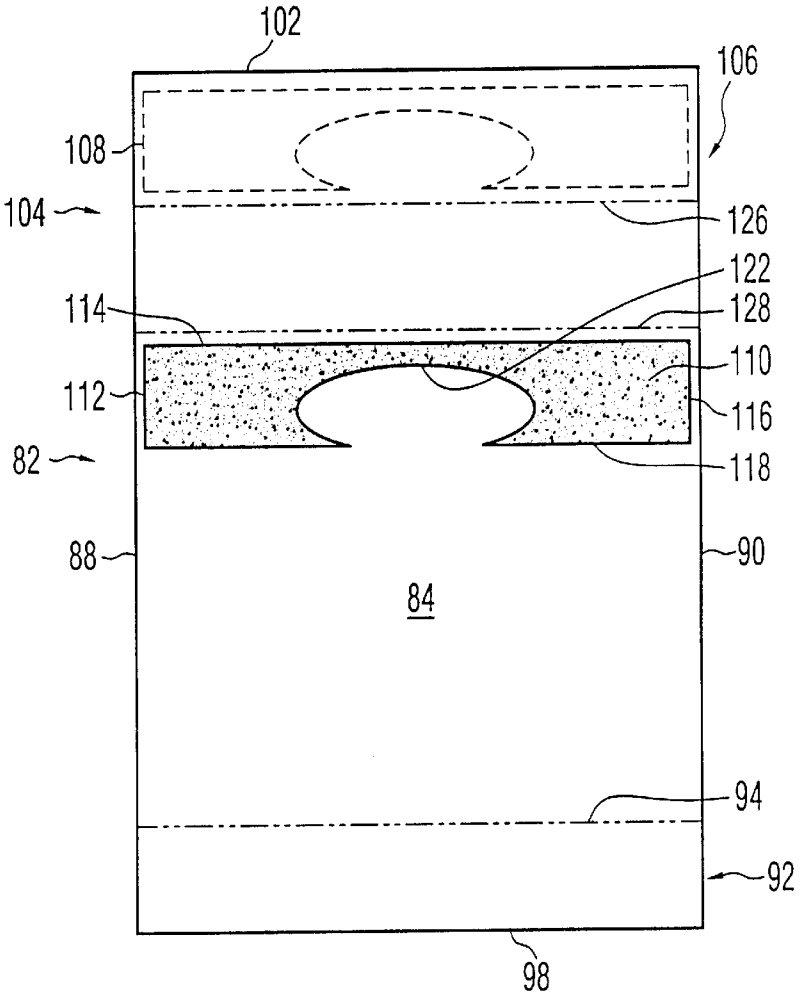
FIG. 7 is a front view of the second bag flattened having the handle closure system.
Figure 6:
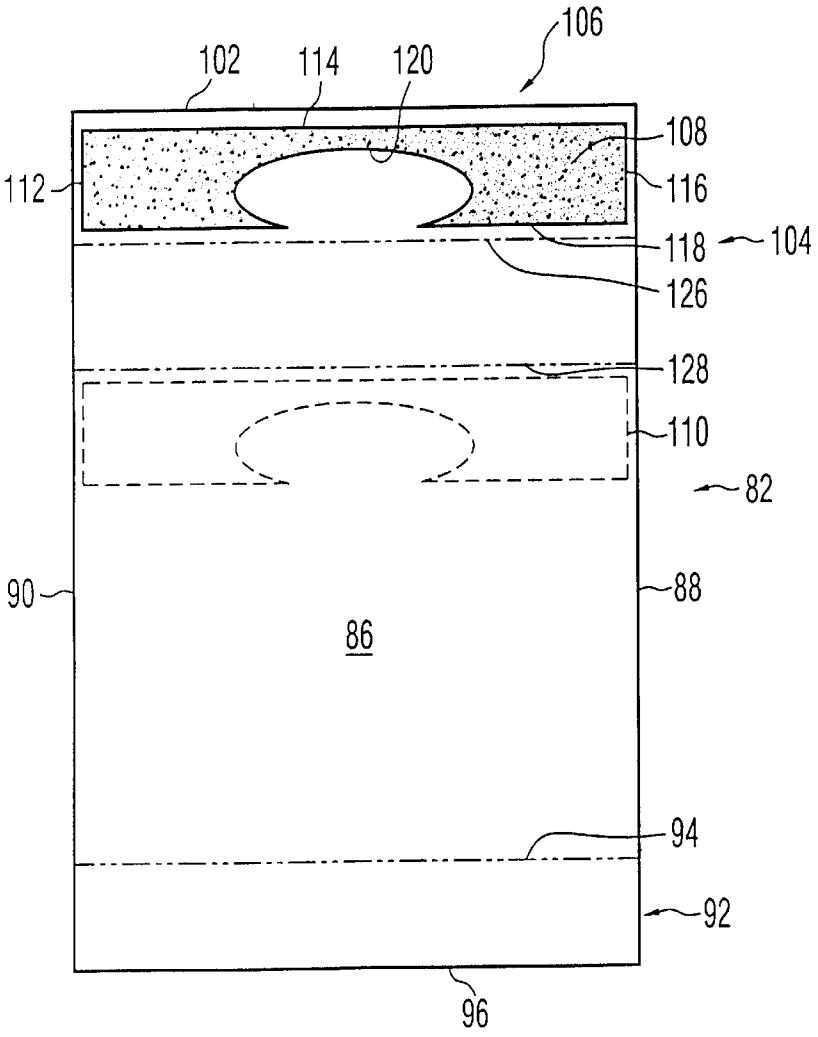
FIG. 6 is a back view of the second bag flattened having the handle closure system.

Referring to FIG. 5, a second conventional bag 82 is shown in a folded closed position. As shown in FIGS. 6–7, the bag is flattened the bag 82 includes a front panel 84 and a back panel 86. The front and back panels 84 and 86 are attached via side seams 88 and 90. As shown in FIGS. 5–7, a bottom gusset 92 is provided, preferably by three folds 94, 96 and 98, on the bottom 100 of the bag 82. The bottom gusset 92 allows for bag expansion when items are placed within the bag 82 through an opening 102 opposite the bottom gusset 92. The bottom gusset 92 is attached to the front and back panels 84 and 86 through the folds, 96 and 98 and side seams 88 and 90. A top portion 104 of the bag 82 is located adjacent the opening 102 (shown in FIGS. 6 and 7). The bag 82 can be stored in a flat position and then expanded when items are placed in the bag 82. A handle closure system 106 is shown at the top portion 104 of the bag 82.

As shown in FIGS. 5–7, the handle closure system is essentially the same as discussed above. The bag 82 features a first closure element 108 and a second closure element 110. The closure elements 108 and 110, as shown, are made of reusable adhesive. Each first and second closure element 108 and 110 has four sides 112, 114, 116 and 118. On one side 118 of at least one closure element 108 a cut-out opening 120 is formed. As shown in FIGS. 6–7, preferably both closure elements 108 and 110 include matching cut-out openings 120 and 122. In the embodiment shown, the cut-out openings 120 and 122 are substantially shaped as elongated ovals. The first and second closure elements 108 and 110 are located on the bag 82 such that when the top portion 104 of the bag 82 adjacent the opening 102 is folded down, the first and second closure elements 108 and 110 mate to close the bag 82 and form a handle 124.

Referring to FIG. 6, the back panel 86 of the bag 82 is shown. The back panel 86 includes a first closure element 108 located adjacent the opening 102 of the bag 82. The cut-out opening 120 is positioned facing away from the opening 102 toward the bottom gusset 92 of the bag 82. Referring to FIG. 7, the front panel 84 includes a second closure element 110 displaced from the opening 102 of the bag 82. The cut-out opening 122 is positioned facing away from the opening 102 toward the bottom gusset 92 of the bag 82. The bottom gusset 92 is folded such that the bag lies flat. As shown in FIG. 6–7, preferably the top portion 104 of the bag 82 is folded along two folds 126 and 128, such that the first closure element 108 is mated with the second closure element 110, and the cut-out openings 120 and 122 substantially align to form a handle 124 with a notch 130 (shown in FIG. 5). The two preferred folds 126 and 128, along with the closure elements 108 and 110 close the bag 20 in such a manner that items cannot easily fall out of the bag 20. The notch 130 is provided for placement of the fingers when the handle closure system 106 is grabbed to carry the bag 82.

Figure 8:
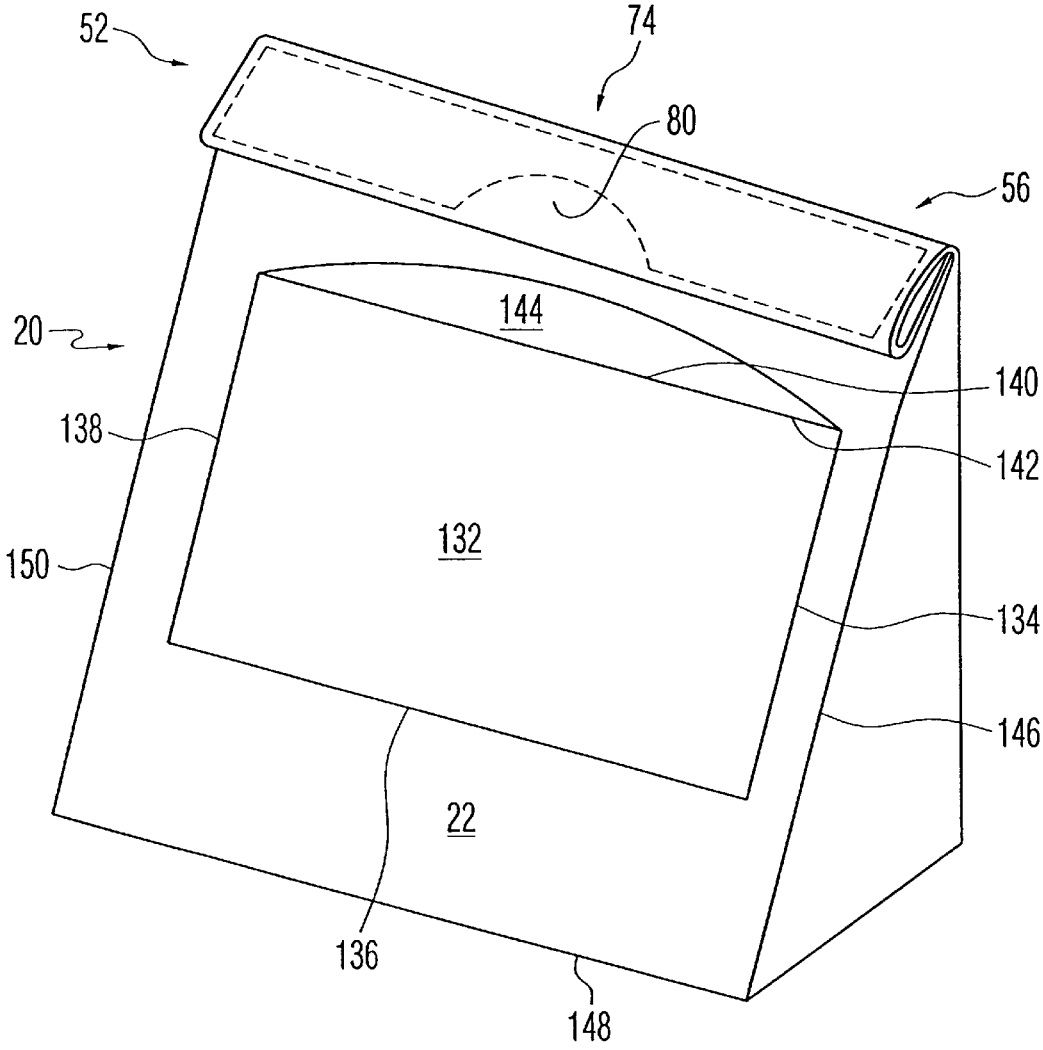
FIG. 8 is a front view of a bag according to the present invention having a pocket.

Referring to FIG. 8, a pocket 132 may be provided on either style of bag 20 and 82 and on either the front 22 and 84 or back panel 24 and 86 or both. Further, the pocket 132 may be located on either the inside or outside of the bag 20 and 82. In FIG. 8, a pocket 132 is shown on the outside of the front panel 22 of bag 20. The pocket 132 has four sides 134, 136, 138 and 140. As shown, first, second and third sides 134, 136 and 138 are attached to the front panel 22. A fourth side 140 forms an opening 142 along a portion of the front panel 22. The pocket 132 may also include a flap 144 over the opening 142 of the pocket 132. As shown in FIG. 8, the flap 144 is flipped up to show the opening 142 of the pocket 132. The pocket 132 could also be placed on the front panel 22 such that the first, second and third sides 134, 136 and 138 of the pocket 132 are attached to three edges 146, 148 and 150 of the front panel 22. The pocket 132 can hold a variety of items including pieces of paper, photos, or even a placemat for use when the bag 20 is functioning as a lunch bag.

FIGS. 9A–9I show a variety of shapes that are usable to form the handle closure system 56 and 106. The first and second closure elements 58, 108, 60 and 10 may be formed like any of these example closure elements or any other shapes that would be suitable to form a notch for accommodating fingers. Preferably, the closure elements 152 have four sides 154, 156, 158 and 160, although they may have more or less than four sides.

Figure 9A:
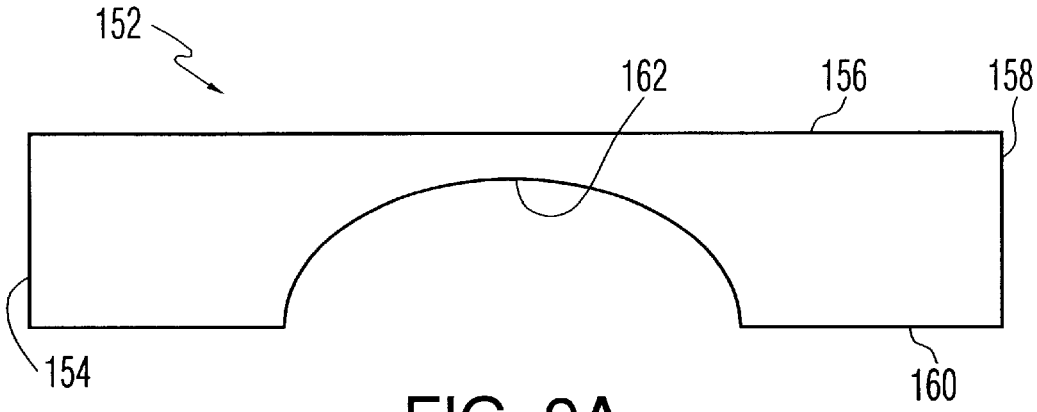
FIGS. 9A–I are front views of possible shapes of the closure elements of the handle closure system according to the present invention.
Figure 9B:
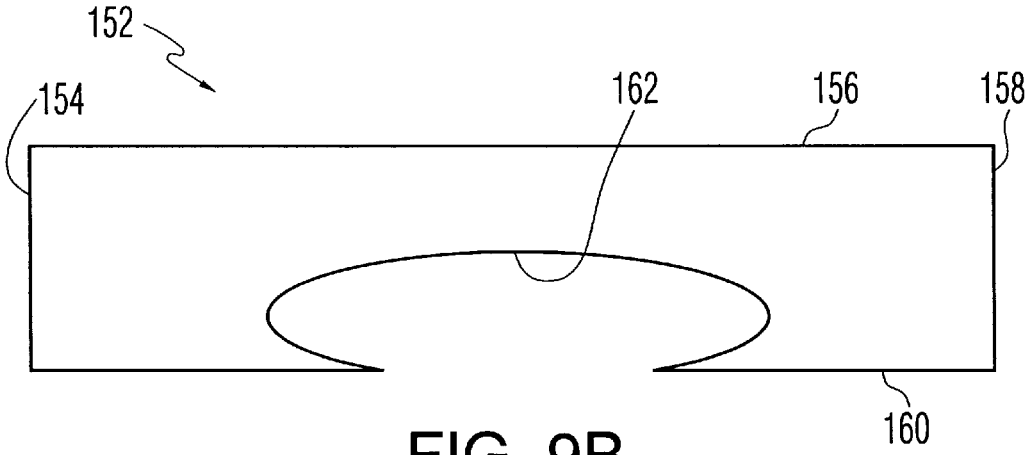
Figure 9C:
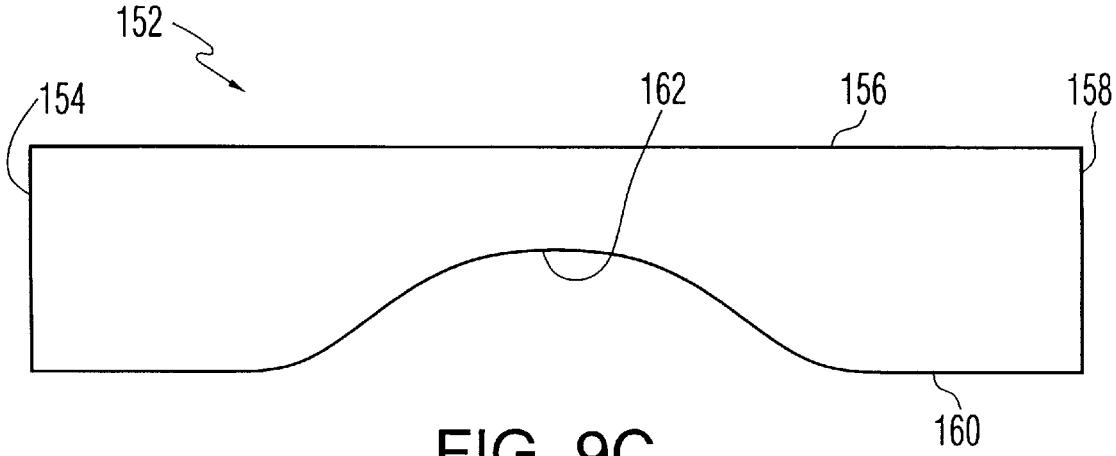
Figure 9D:
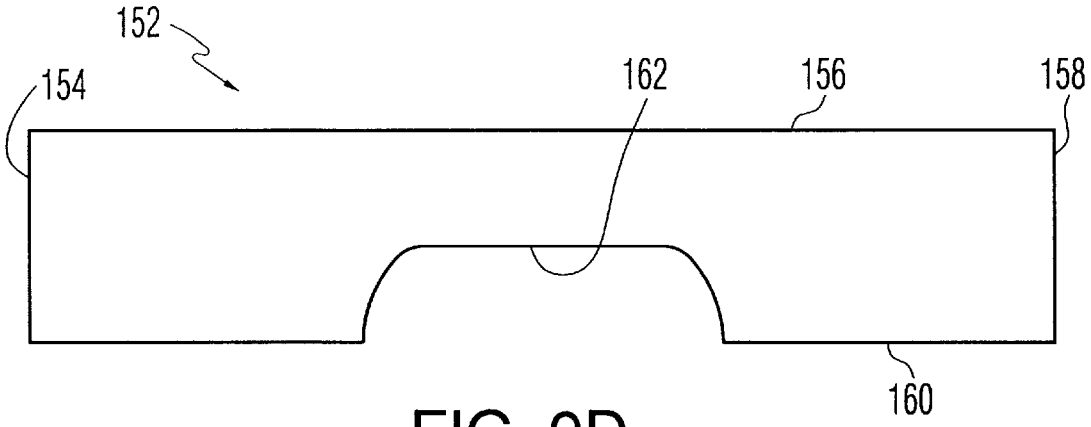
Figure 9E:
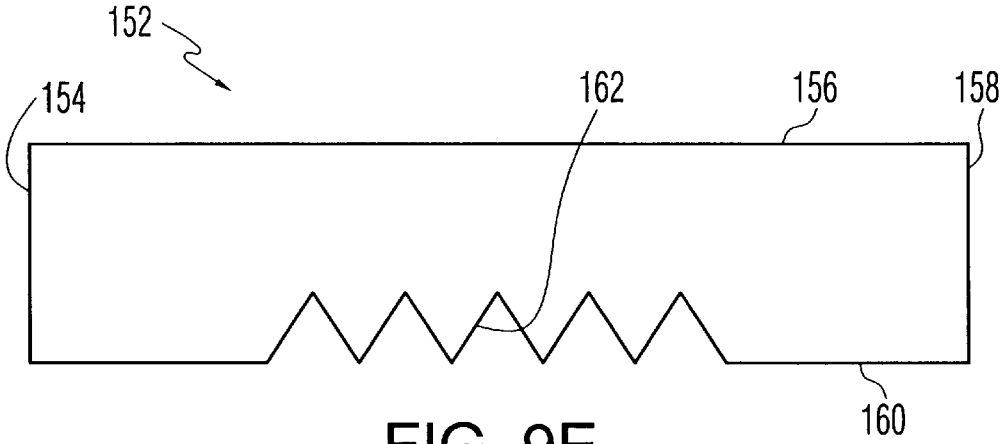
Figure 9F:
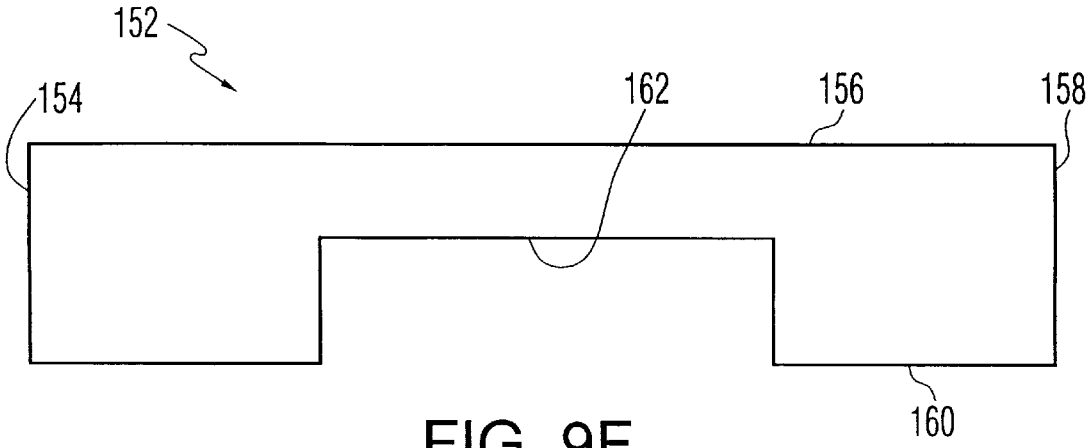
Figure 9G:
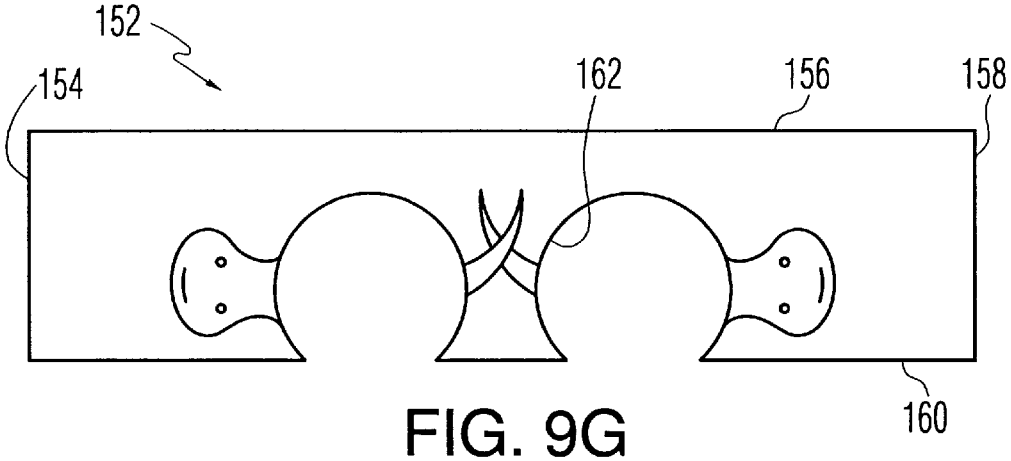
Figure 9H:
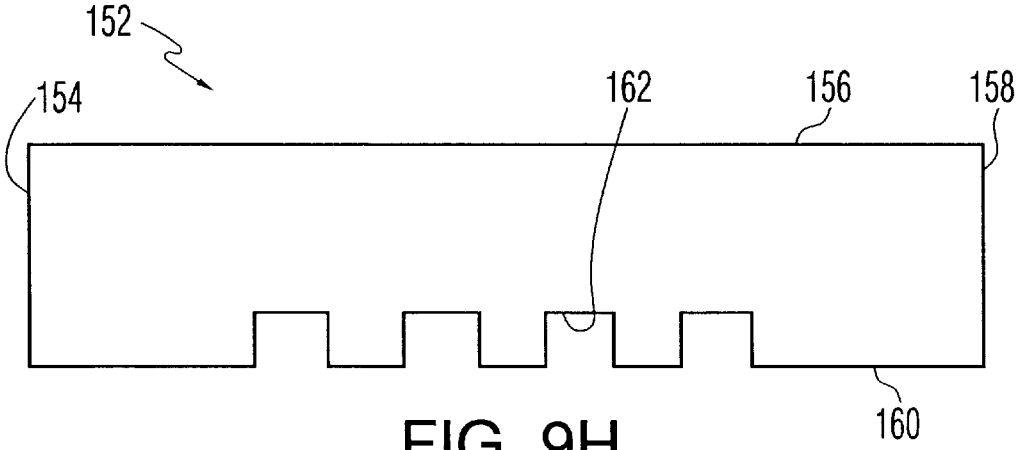
Figure 9I:
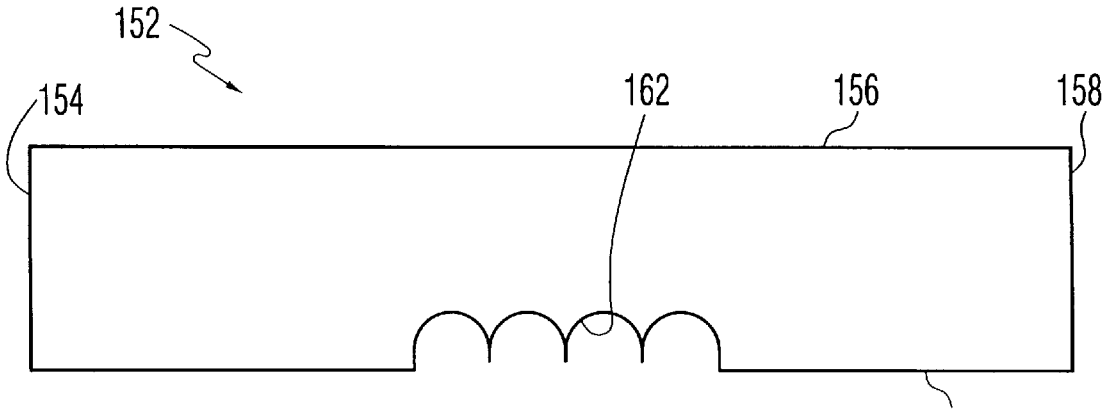

A fourth side 160 includes a formed cut-out opening 162. For example, FIG. 9A shows the preferred embodiment where the cut-out opening 162 is formed substantially as an arc. FIG. 9B shows a second embodiment where the cut-out opening 162 is formed substantially as an elongated oval. FIG. 9C shows the cut-out opening formed substantially as sloped arc. FIG. 9D shows the cut-out opening 162 formed substantially as a rectangle with rounded corners. FIG. 9E shows the closure element 152 having a plurality of cut-out openings 162 formed substantially as a plurality of triangular teeth. A different number or different sized teeth could be used. FIG. 9F shows the cut-out opening 162 formed substantially as a rectangle. FIG. 9G shows closure element 152 having a plurality of cut-out openings 162 formed substantially as an animal finger hole design. A variety of different shaped animals could be formed using cut-out openings 162 for the animals in combination with printing to enhance the appearance of the cut-out openings 162 as animals. FIG. 9H shows the closure element 152 having a plurality of cut-out openings 162 formed substantially as a plurality of rectangular teeth. Once again, the number and size of the rectangular teeth could be varied. FIG. 9I shows the closure element 152 having a plurality of cut-out openings 162 formed substantially as arcs to look like brass knuckles for accommodating finger tips. As will be understood by those skilled in the art, many variations of the cut-out openings on the closure elements can be made.

The handle closure system 56 and 106 may be made with one of the closure elements 152 including a cut-out opening 162 as shown in FIGS. 1–8 or a plurality of cut-out openings 162. However, it is preferable that both closure elements include a cut-out opening 162. Further, as shown it is preferable that the cut-out openings and the entire first and second closure elements are substantially the same.

The bags 20 and 82 can be made of a variety of materials. The bags can be made of a low density polyethylene, a medium density polyethylene, high density polyethylene, and polypropylene in a variety of thicknesses. Also, the bags can be made of a vinyl extruded plastic in various thicknesses. Preferably, the bags are made of a low density polyethylene in a thickness of about 2 to 6 mils. More preferably, the polyethylene is about 4 mils. Because of the materials used to form the bag, the bag is washable and reusable. The insert laced within the bag 20 can be covered with or made out of the same material. Thus, the insert 54 can also be removed and washed. However, because the materials are relatively inexpensive, and the bag can be manufactured inexpensively, the bag can be thrown out after a few uses and a new bag may be used.

Preferably, the first and second closure elements are made of hook and loop fastener. However, a variety of materials could be used including reusable adhesive tape, snaps or other like closure mechanisms known to those skilled in the art. With closure mechanisms such as snaps, a few or more snaps could be placed on the bag outlining the bottom of the closure element to form the same desired shaped cut-out opening for accommodation of the fingers when the folded portion of the bag is grasped. The male portions of the snaps could be placed where the first closure element is located and the female portions of the snaps where the second closure element is located. The hook and loop, snaps or reusable adhesive would be secured to the bag material as known to those of ordinary skill in the art of bag making.

Most preferably, the hook and loop fastener used is SJ3530 hook and SH3531 loop SchotchMate™ Industrial Fastener Utility Products, made by 3M of Minnesota. The hook and loop material is advantageous to use with the folded handle closure system because it assists in preventing items from falling, leaking, and spilling out of the bag. Further, it is helpful in preventing odors from emanating from the bag. The hook and loop materials come in rolls or cut pieces and can be die-cut to the desired shape for the closure elements. The stiff hook portion of the hook and loop material is the male portion, while the pliable loop portion of the hook and loop material is the female portion. The hook and loop fasteners are made of 100% nylon and mate together with slight pressure. They are coated on the backside with a pressure sensitive adhesive.

Preferably, the bag is manufactured as follows. The bag material is a film that is blown up though an extruder machine and processed into either sheeting on rolls or processed into tubing on rolls. The films are extruded with a Corona Treatment to provide better surface adhesion for adhering the closure elements to the surface of the bag material and any ink printed on the surface of the bag. The Corona Treatment alters the surface of the film with micro marks or scuffs not seen with the naked eye. This is done by using an electrical wetting process or electrical shocks to mar the surface of the film. Preferably, the polyethylene used for the bags of the present invention is treated with a 38–40 dyne level. The dyne level can be varied to enhance the adhesion for the particular printing and product used. The films are then allowed to dry, cure and cool down for further processing.

Preferably, any printing desired is now printed on the material by mounting station cylinders and the rolls of film onto a printing press. Preferably, the printing press prints Flexographic printing onto the plastic film material in a high resolution. Next, the rolls are formed into bags by an automated machine through heating, sealing and folding the film.

Separately from the bag forming process, the closure elements are die-cut to the desired size and shape. Preferably, hook and loop material is cut into the closure elements using a knife-edge tooling on a rotary or flat bed press. The material is scored, split, and perforated edge to edge as needed. After the closure elements are cut, they are applied to the bags.

Now the preferred method for adhering the first and second closure elements to the bag will be discussed in reference to the bag of FIGS. 1–4. However, it will be understood that the same process can be used to adhere the handle closure system to other types of bags. This method can be performed by hand or using a semi-automatic part application system. The first closure element 58 and the second closure element 60 are mated together and their respective cut-out openings 70 and 72 substantially align. The first closure element 58 preferably is the male or hook portion of the hook and loop material. The adhesive on this first closure element 58 is exposed and the first closure element 58 is applied to the top portion 52 of the bag 20 on the back panel 24 adjacent the opening 50. Next, the adhesive on the second closure element 60, having the female or loop portion of the hook and loop material, is exposed. The top portion 52 of the bag 20 is folded on the two folds 76 and 78 and the second closure element 60 is adhered onto the front panel 22 of the bag 20. A handle 74 is formed having a notch 80 for accommodating fingers when the folded part of the bag 20 is used as a handle 74. Preferably, the hook and loop portions are additionally secured to the bag 20 using a cold press method.

Additionally, it will be understood that the notch can be made by a cut-out opening on one closure element. Further, it will also be understood that the cut-out opening on one or both closure elements may separate each closure element into two or more pieces.

While the above invention has been described with reference to certain preferred embodiments, it should be kept in mind that the scope of the present invention is not limited to these embodiments. For example, the handle closure system can be made with portions have more or less than four sides. Also, the top portion of the bag could include a flap upon which one of the closure elements could be disposed such that it will mate with the other closure element when the flap is folded down to close the opening of the bag. One skilled in the art may find variations of these preferred embodiments which, nevertheless fall within the spirit of the present invention, whose scope is defined by the claims set forth below. Therefore, it will be understood that the appended claims are intended to cover all such modifications and embodiments which come within the spirit and scope of the present invention.

What is claimed is:

1. A bag having a handle and closure system, the bag having an opening, the system comprising:

a first closure element disposed along a first side portion of the bag near the opening;

a second closure element disposed along a second side portion of the bag, and being configured, dimensioned and positioned for mating engagement with the first closure element, one of said closure elements defining an opening; and a notched handle formed by matins engagement of the first and second closure elements after the first side portion is folded over the bag opening and the first closure element matingly engages the second closure element to close the bag, wherein the notched handle includes a notch formed by the closure element opening and can be grasped by a person's fingers for transport of the bag.

2. The handle and closure system of claim 1 wherein one closure element includes hook material and the other includes loop material.

3. The handle and closure system of claim 1 wherein one or both of the closure elements includes a reusable adhesive thereon.

4. The handle and closure system of claim 1 wherein each closure element includes a cut-out opening which are disposed to form the notch.

5. The handle and closure system of claim 4 wherein each closure element further includes a plurality of cut-out openings which are disposed to form the notch.

6. The closure and handle system of claim 1 wherein the notch has an arcuate periphery.

7. The closure and handle system of claim 1 wherein the notch has an elongated oval periphery.

8. The closure and handle system of claim 1 wherein the notch has a animal shaped periphery.

9. The handle and system of claim 1 wherein the notch has a substantially rectangle periphery.

10. The handle and closure system of claim 1 wherein the bag has four sides with the closure elements provided on two opposed sides, and the remaining two sides forming gussets, with the side having the first closure element folded twice before engaging the second closure element.

11. The handle and closure system of claim 10 wherein the first closure element is located substantially adjacent the bag opening, and each closure element has at least one cut-out opening which faces away from the opening.

12. The handle and closure system of claim 10 wherein the bag further includes a bottom, and an insert for placement in the bottom of the bag.

13. The handle and closure system of claim 1 wherein the bag further includes a pocket on at least one of the sides.

14. The handle and closure system of claim 1 wherein the bag includes a bottom gusset.

15. A bag having a handle and closure system, the bag having an opening, the system comprising:

a first closure element disposed along a first side portion of the bag near the opening;

a first cut-out opening disposed on an edge of the first closure element;

a second closure element disposed along a second side portion of the bag, and being configured, dimensioned and positioned for mating engagement with the first closure element; and a second cut-out opening disposed on an edge of the second closure element;

a notched handle formed by mating engagement of the first and second closure elements after the first side portion is folded over the opening and the first closure element matingly engages the second closure element to close the bag, wherein the notched handle can be grasped by a person's hand for transport of the bag, with a notch formed by the first and second cut-out openings of the first and second closure elements, which notch can accommodate the person's fingers while grasping the handle.

16. The handle and closure system of claim 15 wherein the bag has four sides with the closure elements provided on two opposed sides, and the remaining two sides forming gussets, with the side having the first closure element folded twice before engaging the second closure element.

17. The handle and closure system of claim 16 wherein the first closure element is located substantially adjacent the bag opening, and the first and second cut-out openings which faces away from the opening.

18. The handle and closure system of claim 15 wherein each closure element further includes a plurality of cut-out openings which are disposed to form the notch.

19. The closure and handle system of claim 15 wherein the cut-out openings have an arcuate periphery.

20. The closure and handle system of claim 15 wherein the cut-out openings have an elongated oval periphery.

* * * * *

UNITED STATES PATENT AND TRADEMARK OFFICE
CERTIFICATE OF CORRECTION

PATENT NO. : 6,146,016

DATED : November 14, 2000

INVENTORS : Michael A. Mucci et al.

It is certified that error appears in the above-identified patent and that said Letters Patent is hereby corrected as shown below:

Column 7, line 23 (claim 1, line 10): change "matins" to --mating--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*